US008964980B2

(12) United States Patent
Daniel

(10) Patent No.: US 8,964,980 B2
(45) Date of Patent: Feb. 24, 2015

(54) SYSTEM AND METHOD OF DISTRIBUTING GAME PLAY INSTRUCTIONS TO PLAYERS DURING A GAME

(75) Inventor: Isaac Sayo Daniel, Miami, FL (US)

(73) Assignee: The F3M3 Companies, Inc.

( * ) Notice: Subject to any disclaimer, the term of this patent is extended or adjusted under 35 U.S.C. 154(b) by 928 days.

(21) Appl. No.: 12/614,122

(22) Filed: Nov. 6, 2009

(65) Prior Publication Data

US 2010/0080390 A1 Apr. 1, 2010

Related U.S. Application Data

(63) Continuation-in-part of application No. 12/286,476, filed on Sep. 30, 2008, now Pat. No. 8,126,143.

(51) Int. Cl.
*H04K 1/00* (2006.01)
*A63B 71/06* (2006.01)

(52) U.S. Cl.
CPC ..... *A63B 71/06* (2013.01); *A63B 71/0622* (2013.01); *A63B 71/0619* (2013.01); *A63B 71/0616* (2013.01); *A63B 2071/0647* (2013.01); *A63B 2071/0625* (2013.01); *A63B 2071/0663* (2013.01); *A63B 2225/20* (2013.01); *A63B 2225/50* (2013.01)
USPC ..... 380/251; 380/252; 455/90.1; 455/575.2

(58) Field of Classification Search
CPC ..... A63B 71/0616; A63B 71/0619; A63B 71/0622; A63B 71/0625; A63B 2071/0647
USPC ..... 380/251–252; 455/575.2, 90.1
See application file for complete search history.

(56) References Cited

U.S. PATENT DOCUMENTS

| | | | | |
|---|---|---|---|---|
| 4,536,739 | A * | 8/1985 | Nobuta | 340/323 R |
| 5,142,700 | A * | 8/1992 | Reed | 455/344 |
| 7,171,553 | B2 | 1/2007 | Rix et al. | |
| 7,702,101 | B2 | 4/2010 | Malcolm et al. | |
| 7,810,750 | B2 * | 10/2010 | Abreu | 242/378.1 |
| 2002/0132211 | A1 | 9/2002 | August et al. | |
| 2004/0102931 | A1 * | 5/2004 | Ellis et al. | 702/188 |
| 2005/0170870 | A1 * | 8/2005 | Goldenberg et al. | 455/575.2 |
| 2005/0212202 | A1 * | 9/2005 | Meyer | 273/108 |
| 2006/0029296 | A1 * | 2/2006 | King et al. | 382/313 |
| 2007/0290801 | A1 * | 12/2007 | Powell | 340/7.55 |
| 2008/0089545 | A1 * | 4/2008 | Jannard et al. | 381/374 |
| 2009/0239710 | A1 * | 9/2009 | Shemesh et al. | 482/8 |
| 2010/0304342 | A1 * | 12/2010 | Zilber | 434/157 |

FOREIGN PATENT DOCUMENTS

| | | | |
|---|---|---|---|
| WO | WO 2008/032315 A | | 3/2008 |
| WO | WO 2008032315 A1 | * | 3/2008 |

* cited by examiner

*Primary Examiner* — Jeffrey Pwu
*Assistant Examiner* — Jayesh Jhaveri
(74) *Attorney, Agent, or Firm* — Carol N. Green Kaul, Esq.

(57) ABSTRACT

The present invention is directed to a system and method of distributing game play instructions to players during a game, more specifically a system and method for allowing a portable remote terminal and/or a game apparatus to dynamically transmit and/or receive in game instructions in real-time concerning game play instructions to be effected on the field or court, and to be distributed to one, a plurality, or all team players wearing a headgear configured to receive audio transmissions of the game play instructions from a game play apparatus, another headgear and/or the portable remote terminal.

28 Claims, 2 Drawing Sheets

SYSTEM AND METHOD OF DISTRIBUTING GAME PLAY INSTRUCTIONS TO PLAYERS DURING A GAME

PRIORITY CLAIM

This patent application is a continuation in part of, and claims priority to: United States Non-Provisional patent application Ser. No. 12/286,476 titled An Apparatus and Method for Improving In Game Communications During a Game filed Sep. 30, 2008 now U.S. Pat. No. 8,126,143; PCT Application Serial No. PCT/US2008/013755 titled An Apparatus and Method for Improving In-Game Communications During a Game filed on 16 Dec. 2008; and United States Non-Provisional patent application Ser. No. 12/317,640 titled A System and Method for Improving Game Communications During a Game filed Dec. 23, 2008. The entire disclosures of the afore-mentioned patent applications (both specifications and drawings) are incorporated by reference as if fully stated herein.

FIELD OF THE INVENTION

The present invention is directed to a system and method of distributing game play instructions to players during a game, more specifically a system and method for allowing a portable remote terminal and/or a game apparatus to dynamically transmit and/or receive in game play instructions in real-time concerning game play instructions to be effected on the field or court, and to be distributed to one, a plurality, or all team players wearing a headgear configured to receive audio transmissions of the game play instructions from a game play apparatus, another headgear and/or the portable remote terminal.

BACKGROUND OF THE INVENTION

Some sports allow coaches and/or individual players to provide game play instructions during the game, e.g. basketball, baseball, soccer, volleyball, paintball and football. A game play instruction may include but is not limited to the following: instructions, strategies, location information and or other information. In football, for example, the players are each required to learn all the "plays" in a playbook so that at game time, a coach can selectively call plays with minimal instructions to be executed on the field. However, the aforementioned games have not been able to capitalize on technological advancements in the communications field as the method of communicating the game plays still relies heavily on (a) verbal communications in a huddle; (b) running the plays over speakers; (c) hand signals; or (d) a carefully scripted written playlist on an armband, wristband, waistband or other wearable band.

The problem with the foregoing methods of communications is that they each have their limitations in providing efficient and secure transmissions. For example, a coach's instructions in a huddle risks being overheard and even broadcasted live to the public at large when a game is being televised. In football, calling the plays via speakers are generally not known for their reliability as on occasion, the transmission is garbled, interrupted, or the external noise level on the field is so high that the recipient may not be able to hear the play. As for hand signals that are transmitted either from the sidelines, on or off the field and/or court (collectively "the field"), both the hand signals and the resulting plays are heavily watched by the opposing team to anticipate and counter the play. This is especially true if a coach repeatedly uses the same hand signals to run certain plays. In that event, the opposing team may easily counter the play by calling its own plays, run interferences and/or intercept the ball.

The problem is exacerbated when a player confuses the hand signals and compromises the play by executing something other than the intended game play instruction. For example, a football coach may signal the quarterback from the sidelines to execute "WR 64" or "W Right 64," i.e. "Wide Right 64" requiring the wide receiver to run wide and pass on the right. If the quarterback forgets and or misinterprets the hand signals and instead runs narrow to the left, he may be exposed for interception, a tackle, and/or side out.

Players and coaches alike are very aware of the foregoing limitations and some players, e.g. football players, have resorted to wearing an extra wide wristband, waistband, thighband or other types of wearable bands made of stretchable material with a Velcro® strap that unfolds to reveal a panel where the game plays are committed in writing for quick review. Except, in the heat of the game, the margin for error is still high as the player must unfold this wearable band and review several plays before identifying the intended game play, all within a matter of seconds. Thus, there is a need for a system and method of transmitting and receiving secure transmissions of play instructions in real-time during the game in a format that may be readily received, easily interpreted and universally understood by the players and or coaches.

There is also need for creating a level playing field in sports, adding interest and intrigue to the games as neither team is made privy to the private communications of game play instructions between players and/or their coaches during the game.

This invention satisfies these long felt needs and solves the foregoing problems in a new and novel manner that the prior art has been unable to solve.

SUMMARY OF THE INVENTION

An object of the present invention is to provide a system and method of providing speedy, secure, real-time game play instructions between players and/or coaches during a game that overcomes the limitations of the prior art.

Yet another object of the present invention is to provide a system and method of distributing in-game communications to team members in a private and confidential manner.

Another object of the present invention is to provide at least one player with a headgear and a game apparatus in wireless communication with each other such that the game apparatus may receive game play instructions from a portable remote terminal ("PRT"), and convert the game play instructions to digital audio format, which is transmitted to the headgear where the game play instruction may be audibly heard via speakers positioned within the headgear.

Another object of the invention is to provide a system and method of converting written game play instructions to digital audio format that may be audibly heard in a headgear.

Another object of the present invention is to provide a headgear where the circuit board, electrical circuit, battery, transceiver, speaker and microprocessor are enclosed within a housing that is affixed to the headgear.

Yet another object of the present invention is to provide a headgear which includes a transceiver for receiving transmissions from the PRT, game apparatus or another similarly configured headgear.

Still yet another object of the invention is to provide a system and method, which includes a speaker positioned within a headgear for airing the received digital audio transmission of the game play instruction received from the PRT, game apparatus or another similarly configured headgear.

Another object of the invention is to provide a system and method of distributing game play instructions to players during a game, which may be audibly heard in headgear configured to receive audio transmissions from a game apparatus, another headgear similarly configured or a PRT.

The present invention relates generally to a system and method of distributing game play instructions comprising of a headgear configured for receipt of digital audio transmissions from a game apparatus or portable remote terminal; a computer or the portable remote terminal for receiving input of at least one game play instruction intended for execution on a field during a game and to be distributed to at least one game apparatus or headgear provided to the team players; a game application program executable on the computer or the portable remote terminal, and from which a game play instruction may be inputted via a user interface and communicated wirelessly to the game apparatus; the game apparatus is in wireless communication with the headgear, wherein the game apparatus is configured with a transceiver for receiving an encrypted signal containing a game play instruction intended for execution on a field during a game, wherein the encrypted signal containing the game play instruction is received on the game apparatus; a microprocessor for decrypting the received encrypted signal containing the game play instruction intended for execution on the field during the game; a digital audio converter for converting the decrypted signal containing the game play instruction into digital audio signal containing the game play instruction; and the transceiver for transmitting the converted digital audio signal containing the game play instruction to the transceiver of at least one headgear configured for receipt of the digital audio signal containing the game play instruction from the game apparatus, another similarly configured headgear or the portable remote terminal, where the received digital audio signal containing the game play instruction is aired via speakers positioned within the headgear. The game play instruction includes but is not limited to the following: game instructions, game strategies, a specific play, location information and/or any other allowable game play instructions that may be communicated to a player on/off the field by a coach or another player during a game.

The game apparatus as referenced herein may include any one of the following embodiments: a wristband, ankle band, neckband, armband, waistband, knee band, thigh band or with a belt or any other embodiment that is well known and used in the arts. The PRT may include but is not limited to any one of the following: a cell phone, computer, laptop, personal digital assistant ("PDA") and/or other WLAN communication devices that are known and readily used in the art to transmit and/or receive wireless communications. The PRT may be used by either the coach and or another designated player to transmit or receive game play instructions via the user interface of the game application program that is executable on the PRT. As used herein, illustratively, the PRT is used by the coach to communicate game play instructions to at least one player's game apparatus to be implemented on the field or court during the game. The PRT may includes speech recognition means such that a game play instruction may be inputted by providing an audio command of the game play instruction, where the speech recognition means converts the audio command into a digital data format of the game play instruction for transmission to the game apparatus.

Both the game apparatus and the PRT may include a digital audio converter, used to convert the encrypted and/or decrypted signal containing the game play instruction in digital data format into digital audio signal containing the game play instruction for distribution to at least one player provided with a headgear configured for receipt of transmissions from the game apparatus or PRT. The converted digital audio signal containing said game play instruction may be transmitted to any one of the following: one, two, a plurality, or all headgears provided to teammates.

The system and method may be used for any one or more of the following games, which includes but is not limited to: football, baseball, volleyball, soccer, paintball and basketball as well as any other games where a coach and/or players are allowed to communicate game play instructions to players on or off the field during the game to be executed on the field. The headgear may include but is not limited to: a helmet, goggles, hat, mask, cap, hood, headband or any other headgear that is well known and used in the art suitable for practicing the invention. In certain games, game play instructions are called by either the coach, or a designated player (or players), e.g. a captain or quarterback. The present invention allows one, two, a plurality, or all headgears provided to teammates during the game, e.g. offensive and defensive linemen in football, to simultaneously receive in real-time the select game play instruction as transmitted by the coach and/or another player for a coordinated team execution on the field. Thus, a coach calling a game play instruction during the heat of the game can easily transmit in real-time the intended game play instruction to the players on or off the field where it is distributed audibly to each teammate provided with the headgear configured to receive audio transmissions from the game apparatus, PRT or another similarly equipped headgear. The transmissions between the PRT, the game apparatus and the headgear are all secured with a unique encryption key provided for the sole use of communications among the team. As such, only game apparatuses, PRT(s) and/or headgear(s) for that team's players are able to transmit and/or receive encrypted and/or decrypted electronic signals containing game play instructions for that team. In this manner, the players on the field provided with the headgear can implement the game play instruction on the field, while the players off the field can simultaneously receive the same game play instruction.

In one embodiment, the headgear being provided to at least one team player includes a game apparatus equipped with an electronic circuit, electrical wiring, battery, antennae, microprocessor, transceiver, displaying means and a speaker all enclosed within a housing that may be permanently or temporarily affixed to the headgear. In an alternate embodiment, the headgear does not include a game apparatuses, but includes at least a transceiver and a speaker both positioned within the headgear's interior. In either embodiment, the transceiver of the headgear is configured for transmitting and/or receiving digital audio signals containing game play instructions from any one or more of the following: the game apparatus, portable remote apparatus or another headgear similarly configured for receipt of digital audio signals. The headgear may include a speaker positioned within the headgear for airing the received digital audio signal containing the game play instruction.

The game apparatus' circuit comprises of a circuit board having a microprocessor positioned thereon and electrically connected to the transceiver which receives the encrypted signal containing the game play instruction from a PRT. If the headgear is equipped with a game apparatus, said headgear's game apparatus may function as a PRT for transmitting and receiving wireless communications to other players and or coaches on or off the field. The game apparatus communicates with the PRT via the game apparatus' transceiver, which employ short range wireless protocol. The transceivers used by the PRT, game apparatus or the headgear may comprise of a transceiver with integrated radio and shared antennae, or direct conversion receivers; digital radio receivers; super heterodyne receivers; or any other receivers or transceivers that are well known and used in the art. Preferably, the communication means include Blue Tooth, Zigbee, 802.11 series, or any other short range wireless protocol that is well known and used in the art and other future short range wireless protocol suitable for transmitting and receiving data over a short distance.

The foregoing and other objects and advantages will appear from the description to follow. In the description, references are made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

Further objectives and advantages of the present invention may be derived by referring to the detailed description and claims when considered in connection with the Figures, where like reference numbers refer to similar items throughout the Figures.

DETAILED DESCRIPTION OF THE PREFERRED EMBODIMENT

Figure 1:
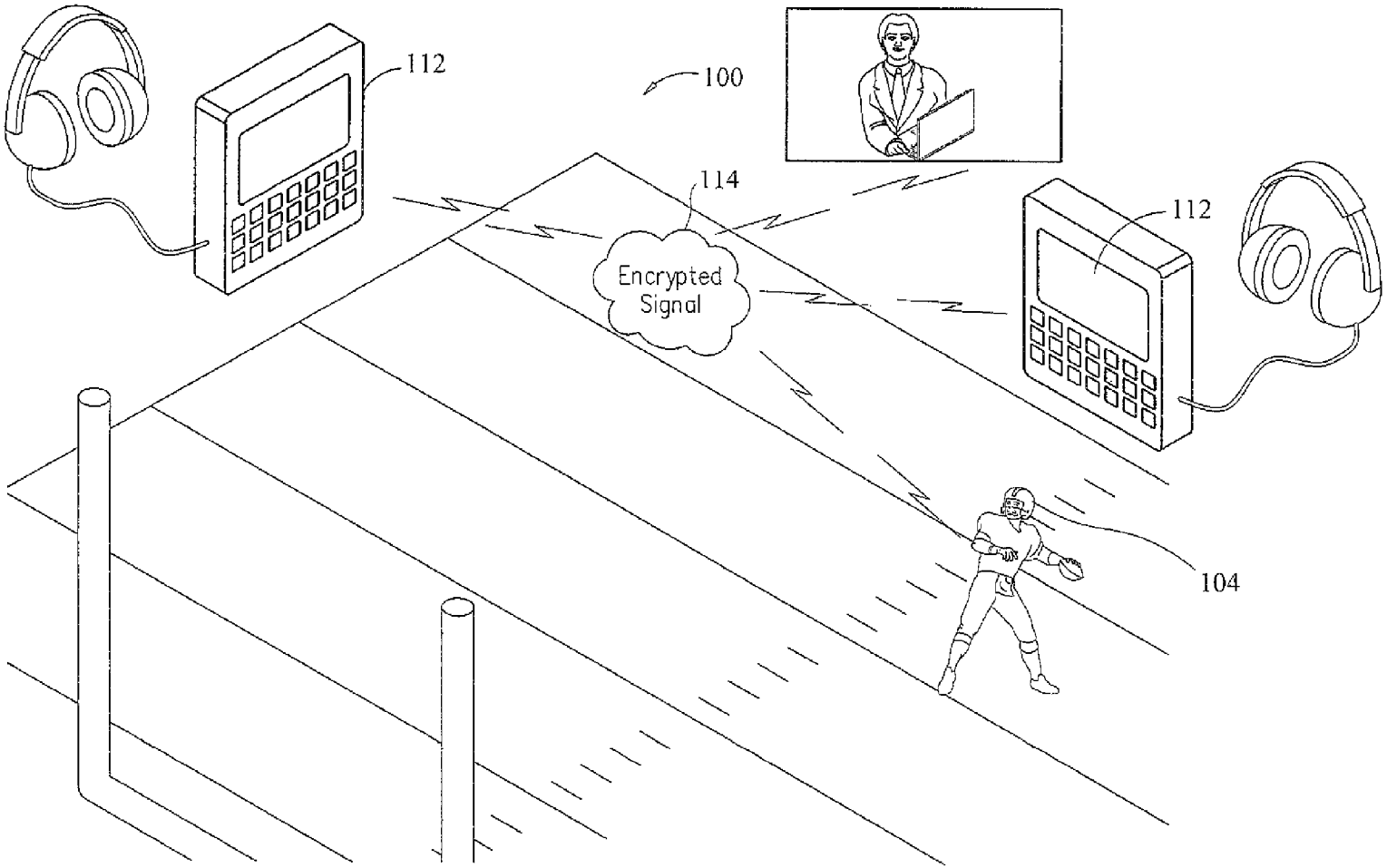
FIG. 1 is an illustrative view of a system according to an embodiment of the present invention.

The following discussion describes in detail an embodiment of the system and method of distributing game play instructions to players during a game. This discussion should not be construed as limiting the invention to these particular embodiments as practitioners skilled in the art will recognize numerous other embodiments as well.

For definition of the complete scope of the invention, the reader is directed to appended claims. Turning now descriptively to the drawings, in which similar reference characters denote similar elements throughout the several views.

Figure 2:
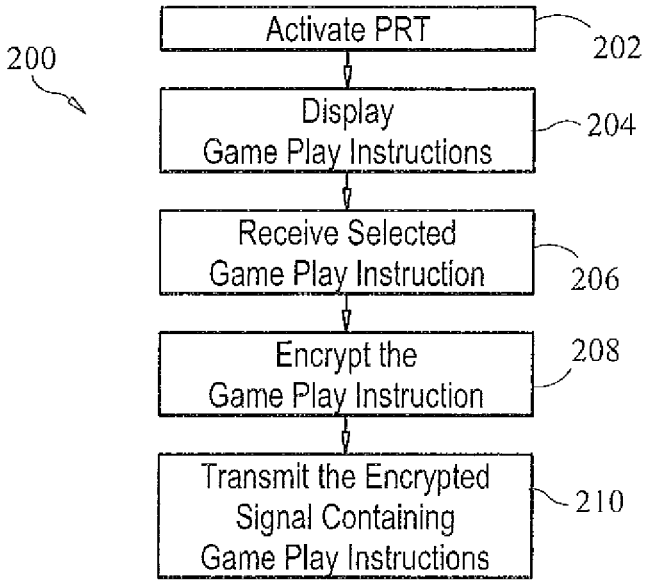
FIG. 2 is an exemplary method of distributing game play instructions to at least one player according to an embodiment of the present invention.

FIGS. 1 & 2 respectively show an illustrative view of a system 100 according to an embodiment of the present invention and an exemplary method 200 of distributing game play instructions 102 (not shown) to at least one player according to an embodiment of the present invention. A game play instruction 102 (not shown) may include but is not limited to the following: game instructions, game strategies, play or location information and/or any other allowable information that may be communicated to a player on/off the field by a coach or another player during a game.

As shown in FIG. 1, the player is provided with a headgear 104 which illustratively is a helmet, where the headgear is configured for receipt of digital audio transmissions from a game apparatus 106 or PRT to a teammate. It is understood that the headgear 104 may include but is not limited to: a helmet, goggles, hat, mask, cap, hood, headband or any other types of headgear 104 that are well known and used in the arts suitable for practicing the invention. The player is also wearing a game apparatus 106 which in the exemplary embodiment is a wristband. Here too, it is understood that the game apparatus 106 as referenced herein may include any one of the following embodiments: a wristband, ankle band, neckband, armband, waistband, knee band, thigh band or with a belt.

In one embodiment, the headgear 104 provided to the player includes a game apparatus 106 (not shown) affixed to the headgear's interior 108 (not shown), which is in wireless communication with the game apparatus 106 being worn as a wristband by that player. However, it is understood that the headgear 104 provided to the player may also be in wireless communication with a game apparatus 106 worn as a wristband by another teammate. In an alternate embodiment the headgear 104 is not provided with a game apparatus 106 (not shown) but includes at least a transceiver 110 (not shown) positioned within the headgear's interior 108. In either embodiment, the transceiver 110 is configured for transmitting and/or receiving digital audio signals 112, 112' containing game play instructions 102, 102' (not shown) to or from a game apparatus 106, other game apparatuses 106, 106 positioned within other teammates' headgears 104, 104', another headgear 104 similarly configured for receiving digital audio signals 112, 112' (not shown) and/or a PRT 114. The received digital audio signal 112 containing the game play instruction 102 may be aired via a speaker 116 (not shown), which is similarly positioned within the headgear's interior 108 (not shown). The game apparatus 106 may be permanently or temporarily affixed to the headgear 104. The headgear 104 may include the speaker 116 (not shown) positioned within the headgear 104 for airing the received digital audio signal 112 containing the game play instruction 102. As such, the headgear 104 may receive the digital audio signal 112 containing the game play instruction 102 from any one or more of the following: game apparatus 106, PRT 114 or another headgear 104 similarly configured for receipt of digital audio signals 112, 112'.

Illustratively a seen in FIG. 1, as a football game progresses a coach located on the field, in the viewing box or anywhere else on or off the field including the nearby vicinity may require for example, a quarterback to execute a particular intended game play instruction 102 (not shown). The coach may activate the PRT 114 (step 202) to select an intended game play instruction 102 (not shown) stored thereon, using a user interface 118 (not shown) of the game application program 120 (not shown) which is executable on the PRT 114 and from which a game play instruction 102 may be inputted and communicated wirelessly to the game apparatus 106. The PRT 114 may include but is not limited to any one of the following: a cellular phone, computer 122 (not shown) such as a network enabled personal computer 122 (not shown), laptop, PDA and/or other WLAN communication devices that are known and readily used in the art to transmit and/or receive wireless communications. The PRT 114 is provided with a game application program 120 (not shown) which includes a playlist of game play instructions 102, 102' (not shown) stored thereon in text, codes and/or visual format. The game application program 120 includes game transaction programming and or other programs for operation within and is configured for wireless connectivity over a network, such Internet. The PRT 114 is also configured for receiving input of a game play instruction 102 intended for execution on a field during a game and to be distributed to at least one game apparatus 106 or headgear 104 provided to players.

Alternatively, the coach may provide an audio game play instruction 102 (not shown), which is converted to digital data format via the speech recognition means 124 (not shown). In another embodiment of the invention, the PRT 114 includes a digital audio converter 140 for converting the select game play instruction 102 into a digital audio signal 112 that may be readily transmitted directly to the headgear 104. The coach and or another player may also input a text message or sketch of the intended game play instruction 102 (not shown) to the PRT 114 to be transmitted to at least one game apparatus 106, e.g. wristband unit, that was provided to a player for use during the game.

If the game play instruction 102 is being selected from the playlist, the PRT 114 may display the game play instructions 102, 102' (step 204) from which a coach (and/or another player) may select the intended game play instruction 102 (not shown). Once the intended game play instruction 102 has been selected, texted, sketched or provided orally to the PRT 114, the PRT 114 receives the select game play instruction 102 (step 206) and encrypts the game play instruction 102 (step 208) to create an encrypted signal 126 containing the select game play instruction 102. PRT 114 then transmits in real-time the encrypted signal 126 containing the game play instruction 102, 102' (not shown) (step 210) intended to be executed on the field during the game, to the transceiver 110 (not shown) of a receiving game apparatus 106.

The receiving game apparatus 106, i.e. the wristband unit, is configured with a transceiver 110 (not shown), antennae 128 (not shown), a microprocessor 130 (not shown), displaying means 132 (not shown), circuit board 134 (not shown), electrical wiring 136 (not shown), battery 138 (not shown), a digital audio converter 140 (not shown) all enclosed within a housing 142. The receiving game apparatus 106 is in wireless communication with the headgear 104, wherein the game apparatus 106 is configured with a transceiver 110 (not shown) for receiving an encrypted signal 124 containing a game play instruction 102 intended for execution on a field during a game, wherein the encrypted signal 124 containing the game play instruction 102 is received by the game apparatus 106. The receiving game apparatus' transceiver 110 (not shown) uses for example WiHLoN™, ZigBee, Blue Tooth, 802.11 series, or any other short range wireless protocol that is well known and used in the art to transmit the encrypted signal 126. The transceiver 110 (not shown) may comprise of a transceiver 110 (not shown) with integrated radio and shared antennae 128; direct conversion receivers; digital radio receivers; super heterodyne receivers; or any other receivers or transceivers 110, 110' that are well known and used in the art. The transceiver 110 (not shown) may include but is not limited to Blue Tooth, ZigBee, 802.11 series, or any other short range wireless protocol that is well known and used in the art and other future short range wireless protocol suitable for transmitting and receiving data over a short distance. Preferably the transceiver 110 (not shown) includes a combined wireless transceiver 110 (not shown), e.g. a ZigBee transceiver 110 with integrated radio and shared antennae 128. However, other wireless transceivers 110, 110' that are well known and used in the art may be used to practice the invention.

Figure 3:
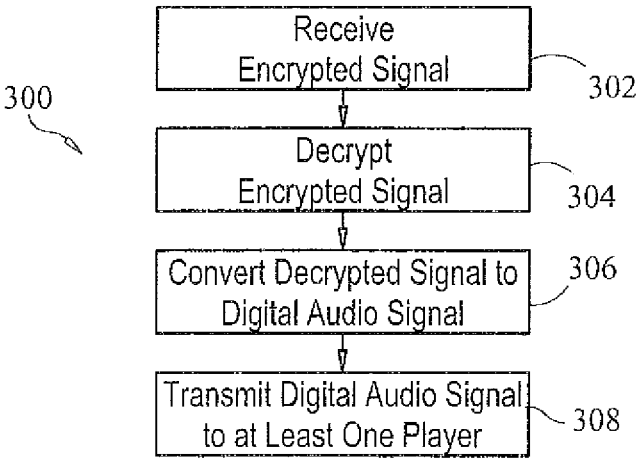
FIG. 3 is an illustrative view of an exemplary method of distributing oral game play instructions to at least one player according to an embodiment of the invention.

FIG. 3 is an illustrative view of an exemplary method of distributing oral game play instructions 102 (not shown) to at least one player according to another embodiment of the invention. The receiving game apparatus' transceiver 110 receives the encrypted signal 126 (step 302) containing the game play instruction 102 (not shown) intended to be executed on the field during the game. Upon receipt, the receiving game apparatus' microprocessor 130 decrypts the received encrypted signal 126 (step 304) containing the game play instruction 102 (not shown) intended for execution on the field during the game. The digital audio converter 140 (not shown) converts the decrypted signal 124 containing the game play instruction 102 (not shown) into a digital audio signal 112 (not shown) containing the game play instruction 102 (step 306). The receiving game apparatus' transceiver 110 (not shown) then transmits the converted digital audio signal 124 (not shown) (step 308) containing the game play instruction 102 via its antennae 128 (not shown) to the transceiver 110 (not shown) of at least one headgear 104 configured for receipt of transmissions, i.e. digital audio signals 124, 124" (not shown) from the game apparatus 106, another headgear 104 similarly configured and/or a PRT 114, where the digital audio signal 124 (not shown) is aired via speakers 116, 116' (not shown) that is positioned within the headgear 104. The converted digital audio signal 124 containing the game play instruction 102 may be transmitted to any one of the following: one, two, a plurality, or all headgears 104, 104' provided to teammates on or off the field. In this manner, the coach's game play instructions 102, 102' (not shown) and/or the players' communications of intended game play instructions 102, 102' to be implemented on the field during the game are transmitted in real-time in a secure environment to the intended recipients only that will not be intercepted, overheard, and/or anticipated by the opposing team or side.

One, some, a plurality or all players on the same team on or off the field provided with the headgear 104 configured for transmitting and/or receiving digital audio signal 112 containing game play instruction 102 (not shown) to or from a game apparatus 106, e.g. a wristband unit, other headgear 104 similarly configured for receipt of digital audio signals 112 (not shown), and/or a PRT 114. In this manner, one, a couple, a plurality or all players wearing the headgear 104 may simultaneously receive in real-time an encrypted signal 126 containing the game play instruction 102 (not shown) via the game apparatus' transceiver 110 (not shown) as transmitted by the coach and/or another player for a coordinated team execution on the field, regardless of whether the player and/or coach is on or off the field.

While the invention has been described in conjunction with football, it is understood that the game apparatus 106, headgear 104, system 100 and method 200, 300 of distributing game play instructions 102, 102' to players during a game may be used for several other games and/or other sporting events which include but is not limited to any one or more of the following: football, baseball, volleyball, soccer, paintball and basketball. While certain novel features of this invention have been shown and described and are pointed out in the annexed claims, it is not intended to be limited to the details above, since it will be understood that various omissions, modifications, substitutions and changes in the forms and details of the system and method illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A system of distributing game play instructions comprising of:

a portable remote terminal, configured for receiving input of at least one game play instruction that includes instructions and strategies for execution on a field during a game, the input being provided from a sketch stored on the portable remote terminal, and from a playlist, text or audio format, and wherein the portable remote terminal includes a digital audio converter for converting the at least one game play instruction from the sketch stored on the portable remote terminal and from the playlist, text or audio format into an encrypted digital audio signal containing the game play instruction to be distributed to at least one game apparatus or headgear provided to players;

the headgear configured for: receiving the encrypted digital audio signal containing the game play instruction from the at least one game apparatus, another headgear and the portable remote terminal; and transmitting the encrypted digital audio signal containing the game play instruction to the at least one game apparatus, another headgear and the portable remote terminal; and broadcasting the game play instruction via a speaker positioned within said headgear.

2. The system of claim 1, further comprising:

(a) a game application program executable on said portable remote terminal, and from which said game play instruction may be inputted via a user interface and communicated wirelessly to said game apparatus; and (b) said game apparatus is in wireless communication with said headgear, wherein said game apparatus is configured with a transceiver for receiving an encrypted signal containing a game play instruction intended for execution on a field during a game, wherein said encrypted signal containing said game play instruction is received by said game apparatus.

3. The system of claim 2, further comprising: a microprocessor for decrypting said received encrypted signal containing said game play instruction intended for execution on the field during said game.

4. The system of claim 1, wherein the portable remote terminal includes a digital audio converter for converting a decrypted signal containing said game play instruction into digital audio signal containing said game play instruction.

5. The system of claim 4, further comprising: a transceiver for transmitting said converted digital audio signal containing said game play instruction to transceiver of at least one said headgear configured for receipt of said digital audio signal containing said game play instruction from said game apparatus or another similarly configured headgear or said portable remote terminal, where the digital audio signal containing said game play instruction that is received is aired via speakers positioned within said headgear.

6. The system of claim 1, wherein said game play instruction includes but is not limited to the following: game instructions, game strategies, a play or location information.

7. The system of claim 1, wherein said portable remote terminal includes speech recognition means.

8. The system of claim 1, wherein said portable remote terminal may include but is not limited to any one of the following: a cell phone, computer, laptop, personal digital assistant.

9. The system of claim 5, wherein said converted digital audio signal containing said game play instruction may be transmitted to any one of the following: one, two, a plurality, or all headgears provided to teammates.

10. The system of claim 1, wherein said system may be used for any one or more of the following games, which includes but is not limited to: football, baseball, volleyball, soccer, paintball and basketball.

11. The system of claim 1, wherein said headgear may include but is not limited to: a helmet, goggles, hat, mask, cap, hood, or headband.

12. The system of claim 1, wherein said headgear is configured for transmitting or receiving digital audio signals containing game play instructions from any one or more of the following: the game apparatus, portable remote apparatus or another headgear similarly configured for receipt of digital audio signals.

13. The system of claim 1, wherein said headgear may receive said digital audio signal containing said game play instruction from any one or more of the following: game apparatus, portable remote apparatus or another headgear similarly configured for receipt of said digital audio signals.

14. The system of claim 1, wherein said game apparatus may include any one of the following embodiments: a wristband, ankle band, neckband, armband, waistband, knee band, thigh band or with a belt.

15. A method for distributing game play instructions comprising of:

receiving input of at least one game play instruction at a portable remote terminal that includes instruction and strategies for execution on a field during a game, the input being provided from a sketch stored on the portable remote terminal, and from a playlist, text or audio format, wherein the portable remote terminal includes a digital audio converter for converting the at least one game play instruction from the sketch stored on the portable remote terminal, and from the playlist, text or audio format into an encrypted digital audio signal containing the game play instruction intended for execution on a field during a game and to be distributed to at least one game apparatus or headgear provided to players;

receiving the encrypted digital audio signal containing the game play instruction from the at least one game apparatus, another headgear and the portable remote terminal, at a headgear; and transmitting the encrypted digital audio signal containing the game play instruction to the at least one game apparatus, another headgear and the portable remote terminal, from the headgear; wherein the headgear is also configured for broadcasting the game play instruction via a speaker positioned within said headgear.

16. The method of claim 15, further comprising activating a game application program executable on said portable remote terminal, and from which a game play instruction may be inputted via a user interface and communicated wirelessly to said game apparatus; and receiving in real-time an encrypted signal containing a game play instruction intended for execution on a field during a game by said game apparatus in wireless communication with said headgear, wherein said encrypted signal containing said game play instruction is received by a game apparatus worn by a player.

17. The method of claim 16, further comprising decrypting said received encrypted signal containing said game play instruction intended for execution on the field during said game.

18. The method of claim 15, further comprising converting a decrypted signal containing said game play instruction to digital audio signal containing said game play instruction.

19. The method of claim 15, further comprising transmitting converted digital audio signal containing game play instruction to transceiver of at least one said headgear configured for receipt of said converted digital audio signal containing said game play instruction from said game apparatus or another similarly configured headgear or said portable remote terminal, where received converted digital audio signal containing said game play instruction that is received is aired via speakers positioned within said headgear.

20. The method of claim 15, wherein said game play instruction includes but is not limited to the following: game instructions, game strategies, a play or location information.

21. The method of claim 15, wherein said portable remote terminal includes speech recognition means.

22. The method of claim 15, wherein said portable remote terminal may include but is not limited to any one of the following: a cell phone, computer, laptop, personal digital assistant.

23. The method of claim 15, wherein converted digital audio signal containing said game play instruction may be transmitted to any one of the following: one, two, a plurality, or all headgears provided to teammates.

24. The method of claim 17, wherein said method may be used for any one or more of the following games, which includes but is not limited to: football, baseball, volleyball, soccer, paintball and basketball.

25. The method of claim 15, wherein said headgear may include but is not limited to: a helmet, goggles, hat, mask, cap, hood, or headband.

26. The method of claim 15, wherein said headgear is configured for transmitting or receiving digital audio signals containing game play instructions from any one or more of the following: the game apparatus, portable remote apparatus or another headgear similarly configured for receipt of digital audio signals.

27. The method of claim 15, wherein said headgear may receive digital audio signal containing said game play instruction from any one or more of the following: game apparatus, portable remote apparatus or another headgear configured for receipt of digital audio transmissions from said game apparatus or said portable remote terminal.

28. The method of claim 15, wherein said game apparatus may include any one of the following embodiments: a wristband, ankle band, neckband, armband, waistband, knee band, thigh band or with a belt.

* * * * *